United States Patent [19]

Rozenwasser

[11] Patent Number: 4,996,835

[45] Date of Patent: Mar. 5, 1991

[54] FINE JEWELRY ROPE CHAIN

[76] Inventor: David Rozenwasser, 26 Har Dafna Street, Savion, Israel

[21] Appl. No.: 460,023

[22] Filed: Jan. 2, 1990

[30] Foreign Application Priority Data

Dec. 8, 1989 [IL] Israel ..... 92607

[51] Int. Cl.[5] ..... B21L 5/02

[52] U.S. Cl. ..... 59/80; 59/3; 59/83

[58] Field of Search ..... 59/1, 16, 3, 20, 29, 59/35.1, 78, 80, 83

[56] References Cited

U.S. PATENT DOCUMENTS

| | | | |
|---|---|---|---|
| 848,299 | 3/1907 | Feid | 59/35.1 |
| 944,640 | 12/1909 | Ungerer et al. | 59/1 |
| 979,110 | 12/1910 | Ungerer et al. | 59/1 |
| 1,011,973 | 12/1911 | Leibbrand | 59/35.1 |
| 1,053,726 | 2/1913 | Hamm et al. | 59/1 |
| 1,055,751 | 3/1913 | Hurley | 59/80 |
| 1,886,784 | 11/1932 | Boppenhausen | 59/83 |
| 4,493,183 | 1/1985 | Bucefari et al. | 59/16 |
| 4,503,664 | 3/1985 | Allazzetta et al. | 59/16 |
| 4,651,517 | 3/1987 | Benhamou et al. | 59/20 |

FOREIGN PATENT DOCUMENTS

| | | | |
|---|---|---|---|
| 014648 | 11/1989 | Benelux | |
| 2829854 | 1/1980 | Fed. Rep. of Germany | 59/23 |
| 0050750 | 5/1981 | Japan | 59/35.1 |
| 8604491 | 8/1986 | World Int. Prop. O. | 59/80 |

*Primary Examiner*—David Jones

*Attorney, Agent, or Firm*—Helfgott & Karas

[57] ABSTRACT

A jewelry rope chain having tightly interfitting links made of wire of a given cross-section, each link having a small gap formed therein slightly larger than the cross-section of said wire, so as to enable one of said links to pass through the gap of a second such link, said links being intertwined to fit tightly one against the other and form in outward appearance a double helix, the improvement being that each link comprises a non-circular geometric shape, said shape comprising a major axis defining long outer and inner diameters and a minor axis defining shorter outer and inner diameters, said gap lying in a link section parallel to the major axis and said shorter inner diameter being just over X times greater than the cross-section of the link wire, where X is a number equal to or greater than 3.

8 Claims, 5 Drawing Sheets

PRIOR ART
Fig. 5
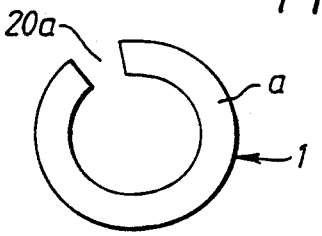
PRIOR ART
Fig. 6
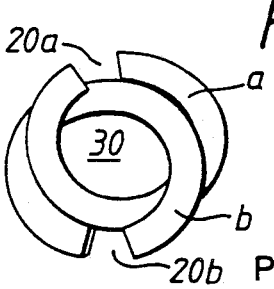
PRIOR ART
Fig. 7
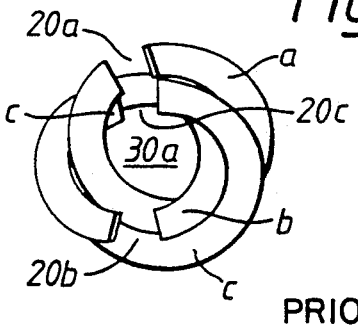
PRIOR ART
Fig. 8
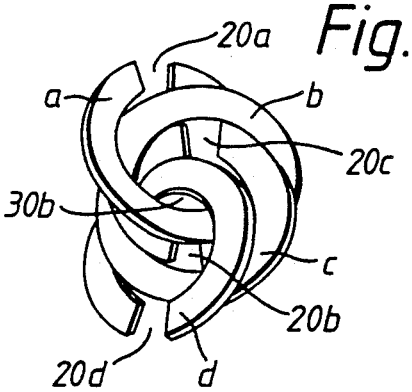
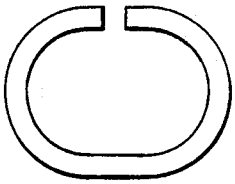
Fig.17a
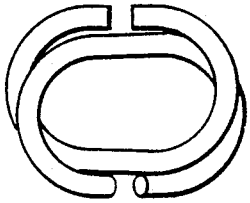
Fig.17b
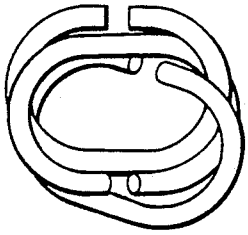
Fig.17c
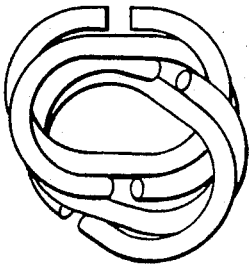
Fig.17d
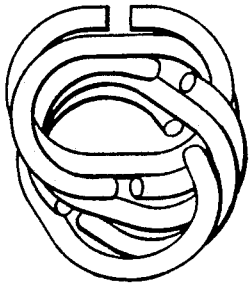
Fig.17e
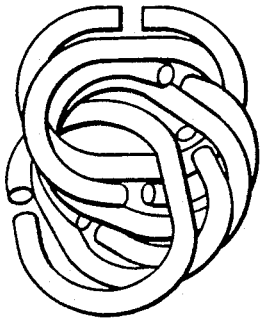
Fig.17f

FINE JEWELRY ROPE CHAIN

FIELD OF THE INVENTION

The present invention relates to novel hand-made jewelry chains, specifically of the type known as rope chains, and to a method for making same.

BACKGROUND OF THE INVENTION

Rope chains made from precious metals have, for decades, been made largely by hand. The method of making such chains until this very day will now be described in detail with reference to FIGS. 1 to 8. The basic construction element, or component, of such rope chains is a ring formed of a solid or hollow wire, usually of precious metal, e.g. 14 karat gold. A ring 1 shown in FIG. 1 has an opening or gap 2 formed therein. This gap 2 has a narrow dimension 3 at its inner diameter and a wider dimension at its outer diameter.

The solid wire forming the ring (FIG. 2) usually has flattened sides 4 and rounded ends 5 which give the ring 1 a major diameter 6 and a minor diameter 7. The cross-section of the wire forming the ring 1 may also be of generally circular cross-section. The gap 2 of ring 1 is substantially larger than the minor diameter 7 and is slightly larger than the major diameter 6 at its narrowest dimension 3.

A multiplicity of such rings 1 are intertwined to form, in outward appearance, a double helix, as shown in FIG. 3, which is the format for a standard rope chain. These tightly interfitting ring rope chains are hand-made.

For the longest time these chains were made from split annular rings having a 3:1 ratio of ring inner diameter to major wire diameter. U.S. Pat. No. 4,651,517, which is incorporated herein by reference, disclosed that it is possible to produce a rope chain with significant weight savings by using thinner annular split rings having an inner ring diameter slightly more than X times the major wire diameter, where X is an odd number greater than 3. The arrangement of the split rings with respect to one another in building the chain length is the same in this patent as in the previous practice. This arrangement is shown and described in FIGS. 5–7, where X equals 3. The first ring forming the rope chain will be termed the ring "a". It is the first of a series of four rings forming a ring assembly.

The relative orientation of the rings forming the rope chain according to this prior art is important. The ring "a" is initially oriented (manually) so that its gap, designated 20*a*, lies in a predetermined direction, e.g. facing generally upwardly, as in FIG. 5. The second ring of this assembly, designated as "b" ring, is passed through the gap 20*a* of the ring "a", with the gap 20*b* of the ring "b" facing downwardly at about 180° removed from the ring gap 20*a* of ring a "a", as shown in FIG. 6. The rings "a" and "b" are juxtaposed and intertwined so that they lay against each other, with the periphery of the ring "b" lying against the periphery of the ring "a", to the greatest extent possible, thereby creating a relatively large central opening 30 with the pair of intertwined abutting "a" and "b" rings. The plane of the ring "a" lies in parallel to the plane of the paper, and the plane of the ring "b" is slightly skewed from the a plane.

The gap 20*c* of "a" third ring "c" is then passed through the gap 20*b* of the ring "b" and over the minor diameter of the ring "a" and laid angularly against the "a" and "b" rings "a" and "b", the gap 20*c* of the ring "c" lying in the same orientation as the gap 20*a* of the ring "a", and as shown in FIG. 7, but with its plane more greatly skewed than the rings "a" and "b". A central opening 30*a* still remains within the now three intertwined rings "a", "b" and "c". The planes of each of the rings differ from each other by perhaps about 20° because of their angular abutment. In the case where X equals 5, the cross-section of the rings is smaller and the planes of the rings would differ from each other by about 15°.

Turning now to FIG. 8, the gap 20*d* of a fourth ring "d" is now passed over the rings "a", "b" and "c", through the central opening 30*b*, and thereby envelops the rings "a", "b" and "c" to substantially fill the central opening 30*b* with rings. The ring "d" is laid against the other rings (a–c) and its plane lies approximately 20° from the plane of the "c" ring. The gap 20*d* of the ring "d" is disposed in the same orientation as the gap 20*b* of the ring "b".

The just-described intertwining and orientation of a–d rings permits the continuation of the intertwining of additional assemblies of rings (of four rings each, where X=3, or 6 rings each when X=5 etc.) to create a "double helix" rope chain of a desired length. The adding on of an additional assembly of four rings is a repetition of the orientation previously described with reference to the a–d ring, but the planes of this second assembly lie at approximately 90° to the planes of the respective rings in the first assembly.

It is to be noted that the gaps of the first and third ring additions of a second ring assembly abut the previous first and third rings, and the second and fourth rings pass through the gaps of the previous second and fourth rings and that the relative orientations of the gaps of the rings alternate between adjacent rings about 180°. Thus, as far as the operator is concerned, he or she is always alternating the gap orientation while intertwining each additional ring.

After building up the rings in the manner just described, to form the double helix rope chain (FIGS. 5–8), the rings are held in the desired juxtaposition temporarily by a thin metal wire 25 wrapped about the rings (FIG. 4). Then solder S is intermittently applied, e.g. to every pair of adjacent rings usually at two points of the external periphery thereof. The wire 25 is then removed. The intermittent soldering S results in a rope chain wherein every ring pair is slightly movable, with respect to its adjacent ring pairs, and results in a chain having the desired flexibility for forming a necklace or bracelet.

In my earlier patent application on which U.S. Pat. No. 4,934,135 issued Ser. No. 07/286,657 filed 19 Dec., which is incorporated herein by reference, I disclosed that it is possible to prepare high quality rope chains with further additional savings and variability by having X be equal to or greater than 3, said rope chain being formed by a plurality of assemblies of rings in series, each assembly comprising X+1 rings, each ring of said assembly being angularly intertwined with an adjacent ring, each of said assembly of rings comprising at least one ring oriented with its gap turned about 180° with respect to the gap of at least one other ring within said assembly, wherein each assembly of rings comprises at least one group of two or more adjacent rings having their gaps in the same orientation, at least two or more adjacent rings being fixedly attached to each other, each of at least one group of two or more adjacent rings being also fixedly attached to another ring having a gap orientation about 180° with respect to the gaps of the rings of said group of two or more adjacent rings, and the end ring of each assembly in the series envelops the other rings of said assembly.

The above innovative method permits the manufacture of rope chains having variable ring assemblies of both even and odd numbers, i.e. where the ratio of the inner diameter of the ring to its cross-section, X, can be any even or odd number from 3 and above. This is made possible by fixing the similarly oriented adjacent rings to one another, so that each group of such similarly oriented rings can be considered and treated as if it were a single ring with a single gap.

To illustrate this above method of preparing a rope chain, we refer to FIG. 10. Here we see two ring assemblies, "a" to "d" and "aa" to "dd", each having one group of three adjacent rings b-c-d and bb-cc-dd with the same gap orientation and only two rings, "a" and "aa", with gaps oriented 180° with respect of these groups of rings. The rings "d" and "dd" envelop (52, 53) the previous rings of their respective ring assemblies. This arrangement of rings requires that the groups of rings, b-c-d and bb-cc-dd, be soldered at S together to form single units. The last ring "d" and "dd" of each assembly is, in this case, soldered at $S_1$ to the first ring "aa" and "ee" of the next assembly. In this example, the number of rings which must be manipulated for each assembly and turned 180° with respect to the previous ring is only one, which is a ⅔ saving of time for this type of manipulation. Overall, this arrangement can save approximately 18–20% of labour costs in the manufacture of such a rope chain.

SUMMARY OF THE INVENTION

It is an object of the present invention to provide a fine jewelry rope chain produced manually with significant time saving.

It is a further object of the invention to provide a jewelry rope chain with significant savings in amount of precious metal required for its manufacture.

It is yet another object of the invention to provide the possibility of making a larger variety of rope chains than has been possible heretofore.

These and other objectives are achieved by providing a jewelry rope chain having tightly interfitting links made of wire of a given cross-section, each link having a small gap formed therein slightly larger than the cross-section of said wire, so as to enable one of said links to pass through the gap of a second such link, said links being intertwined to fit tightly one against the other and form in outward appearance a double helix, the improvement being that each link comprises a non-circular geometric shape, said shape comprising a major axis defining long outer and inner diameters and a minor axis defining shorter outer and inner diameters, said gap lying in a link section parallel to the major axis and said shorter inner diameter being just over X times greater than the cross-section of the link wire, where X is a number equal to or greater than 2. In a preferred embodiment, the links comprise rounded ends and flattened sides.

In accordance with this invention, the weight of a given rope chain can be controlled while keeping its width constant. This can be achieved by merely adjusting the shorter dimension of the link and the link wire cross-section and still maintain the same number of links per assembly. According to the prior art, reduction of weight of the chain required reducing the wire cross-section and increasing the number of links per assembly. Thus, for example, when making a prior art chain with rings of 5.8 mm outer diameter and 4.2 mm inner diameter, one uses five rings each of 0.8 mm cross-section (X=5). To reduce the weight of such a chain and keep its width (5.8 mm) one would have to reduce the cross-section of the wire, thereby increasing the inner diameter of the ring and thus requiring more rings per assembly in order to fit the requirement that each ring have an inner diameter a little larger than X times the wire cross-section. This requirement is necessary because the intertwined links must not move around loosely, but must be tightly engaged with one another along their entire circumference, otherwise the chain cannot be produced. According to the present invention, however, if one wished to reduce the weight of a rope chain of a given thickness, one merely has to reduce the cross-section of the link wire and the shorter dimension of the link, so that the ratio of shorter dimension to wire cross-section is slightly greater than X as discussed above.

A further advantage of this invention is that it is easier to intertwine one link with another when the links are not circular, since the links do not slip as readily and the gap does not move from the desired orientation. This is of importance with respect to labour time involved.

Yet another advantage of the invention is that for any given thickness of rope chain, i.e. of similar outside diameter, each link is inserted into the other over a shorter distance than in the case with prior art ring links.

The precious metals contemplated for fine jewelry rope chains of this invention include, but are not limited to, gold, platinum, silver and their alloys.

The line wire for this invention may have any geometric shape, such as round, oval, polygonal and irregular, and may be solid, hollow or semi-hollow.

Non-circular links within the scope of this invention include, but are not limited to, the following shapes: oval, rectangular triangular, hexagonal, octagonal, and in fact any polygonal or rounded shape having both a long and short dimension.

BRIEF DESCRIPTION OF THE DRAWINGS

The invention will now be discussed with reference to the drawings, in which

FIGS. 5–8 show, in sequence and in perspective, the build-up of a standard rope chain from open rings;

FIGS. 17*a* to 17*f* show in sequence and in perspective the build-up of a rope chain in accordance with one embodiment of this invention using a link of FIG. 3.

DETAILED DESCRIPTION OF THE PREFERRED EMBODIMENTS

FIGS. 1 through 10 were already discussed earlier.

FIGS. 11–16 represent only a sampling of possible chain links suitable for this invention. They all have in common a chain link which is non-circular, having a long and a short dimension, and whose gap is on the long side of the link.

Referring to FIGS. 17*a*–17*f*, these illustrate the method of building up a rope chain with elongated links, in this case X being equal to 5. The procedure is similar to that of the prior art showin in FIGS. 5–8.

Figure 18:
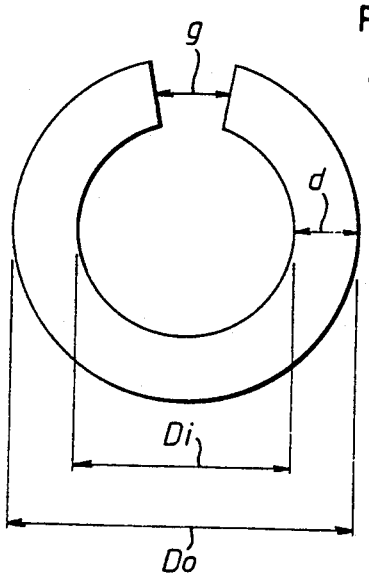
PRIOR ART Fig.18
FIGS. 18–20 illustrate comparative rope chain links of the prior art and according to the present invention.
Figure 19:
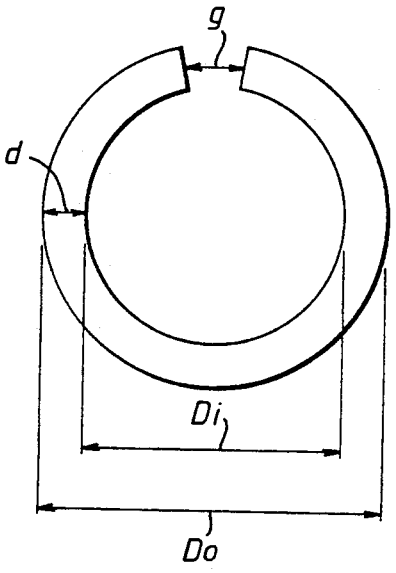
PRIOR ART Fig.19
Figure 20:
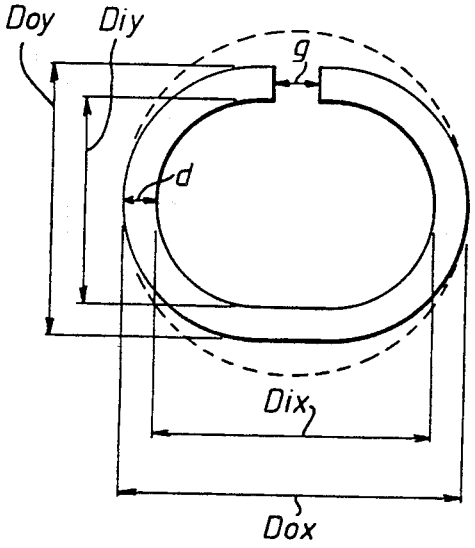

FIGS. 18–20 illustrate three different chain links. The links of FIGS. 18 and 19 are those disclosed in U.S. Pat. No. 4,651,517 and my earlier patent application Ser. No. 88,356 matured into U.S. Pat. No. 4,934,135 as mentioned above. Both links are completely circular with only a single outer and a single inner diameter. In FIG. 18 is illustrated a ring of the very old art wherein the ratio of the inner diameter $D_i$ to the wire cross-section d is just over 3. In FIG. 19, which was disclosed in U.S. Pat. No. 4,651,517, this ratio is a little over 5.

FIG. 20 illustrates a most preferred chain link useful according to the present invention, having a long and a short dimension. This link comprises long and short outer diameters $D_{ox}$ and $D_{oy}$ and long and short inner diameters $D_{ix}$ and $D_{iy}$, where x is the longer dimension and y the shorter one.

Table I summarizes approximate calculated data for links of FIGS. 18–20 and rope chains made therefrom, which illustrates that if the longer dimension of the link is kept constant (which determines the thickness of the rope chain) significant advantages are obtained both as to weight saving and assembly time by using the links in accordance with the present invention.

TABLE I

Figure 1:
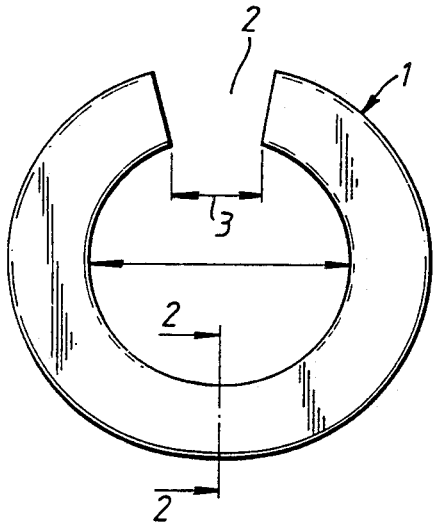
PRIOR ART Fig. 1
FIG. 1 is a plan view of an open ring used for making rope chains.
Figure 2:
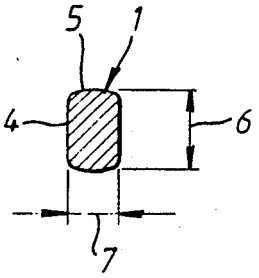
PRIOR ART Fig. 2
FIG. 2 is a cross-section of the wire forming the ring of FIG. 1 taken along the lines 2—2.
Figure 3:
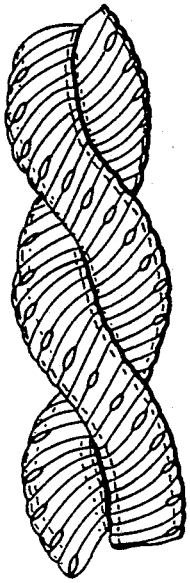
PRIOR ART Fig. 3
FIGS. 3 and 4 are side elevations showing sections of finished and unfinished rope chains.
Figure 4:
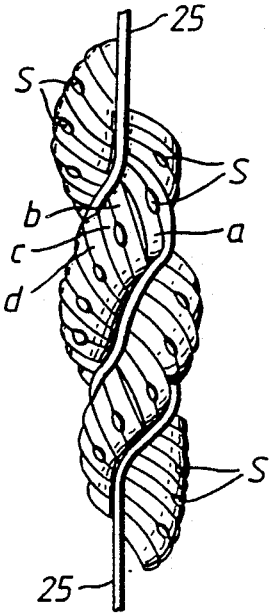
PRIOR ART Fig. 4
Figure 9:
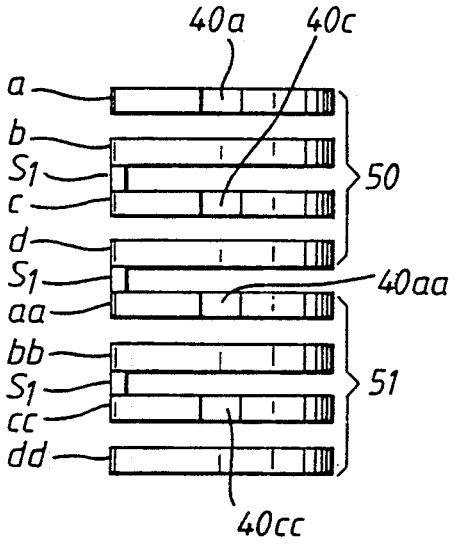
FIG. 9 is a schematic representation of a section of rope chain with the ring gap orientation alternating 180° as in FIG. 8 wherein the internal diameter is slightly greater than 3 times the ring wire cross-section.
Figure 10:
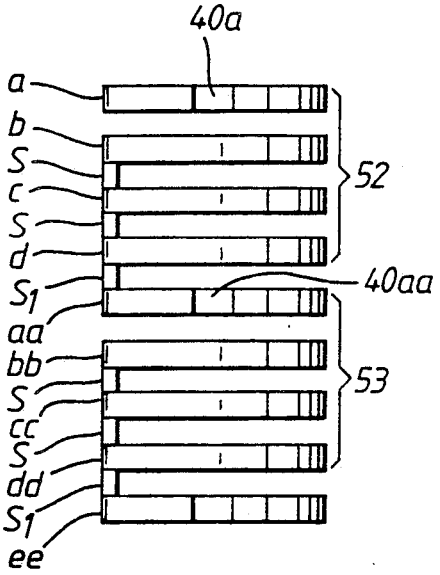
FIG. 10 is a schematic representation of a section of rope chain having a different ring gap orientation, also with an internal ring diameter to wire cross-section ratio of a little over 3:1 as in FIG. 9.
Figure 11:
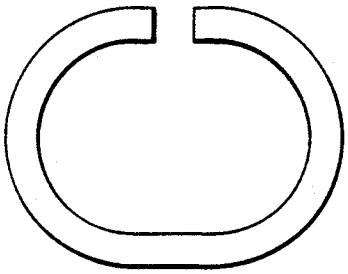
FIGS. 11 through 16 are plan views of chain links for use in accordance with this invention.
Figure 12:
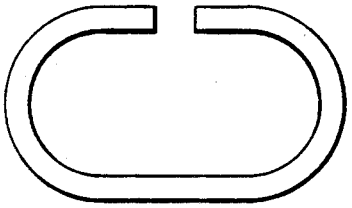
Figure 13:
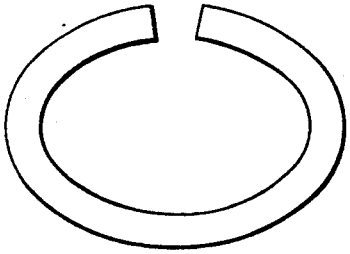
Figure 14:
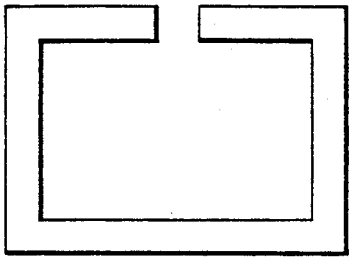
Figure 15:
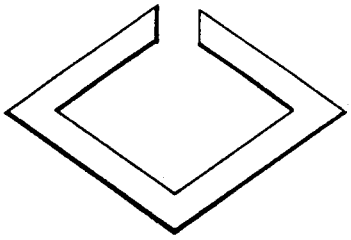
Figure 16:
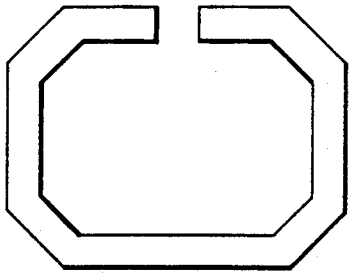

| | Comparative date of different chain links | | |
|---|---|---|---|
| | FIG. 8 | FIG. 9 | FIG. 10 |
| $D_{ox}$ | 5.8 mm | 5.8 mm | 5.8 mm |
| $D_{oy}$ | 5.8 mm | 5.8 mm | 4.44 mm |
| $D_{ix}$ | 3.66 mm | 4.2 mm | 4.6 mm |
| $D_{iy}$ | 3.66 mm | 4.2 mm | 3.24 mm |
| d | 1.07 mm | 0.8 mm | 0.6 mm |
| r | 0.535 mm | 0.4 mm | 0.3 mm |
| $\frac{D_{iy}}{d}$ | 3.42 | 5.25 | 5.4 |
| X + 1 | 4 | 6 | 6 |
| g | 1.2 | 0.9 | 0.7 |
| $V_1$ | 12.97 $mm^3$ | 7.65 $mm^3$ | 4.51 $mm^3$ |
| L/m | 690 | 1034 | 1351 |
| V/m | 8944 | 7913 | 6093 |
| S | — | 11.5% | 11.6% |

$D_{ox}$ = outer longer dimension
$D_{oy}$ = outer shorter dimension
$D_{ix}$ = inner longer dimension
$D_{iy}$ = inner shorter dimension
d = cross-section diameter of link wire
r = radius of link wire $\frac{d}{2}$
X + 1 = number of links per assembly
g = gap distance
$V_1$ = volume of each link
L/m = number of assembled links per meter $\frac{1000}{D_{ox}} \cdot X + 1$
V/m = volume of links in 1 meter of chain (V × 1/m)
S = % saving in materials over immediately preceding example.

The data in Table I is only an approximation for purposes of demonstrating the general principle and was calculated as follows:

With respect to FIGS. 18 and 19:

Volume of link ($V_1$) = volume of ring ($V_r$) − Volume of gap ($V_g$)

$$V_1 = V_r - V_g$$

$$V = \pi r^2 h$$

$$h = \pi D_o$$

where $D_o$ is the outer diameter and g is the gap.

$$V_1 = \pi r^2 \cdot \pi D_o - \pi r^2 \pi g$$

$$V_1 = \pi^2 r^2 D_o - \pi^2 r^2 g$$

For FIG. 18 $V_1 = 16.36\ mm^3 - 3.39\ mm^3 = 12.97\ mm^3$.
For FIG. 19 $V_1 = 9.15\ mm^3 - 1.5\ mm^3 = 7.65\ mm^3$.
For FIG. 20:

$$V_1 = V_f + 2VD_{ox} - D_{oy} - V_g$$

where $V_f$ is the volume of the full link and $V_g$ is the volume of the gap. $D_{ox}$ and $D_{oy}$ are the respective long and short diameters along the x and y axes.

$$V = \pi r^2$$

$$h = \pi D_{oy} + D_{ix}$$

$$V_f = \pi r^2 [\pi D_{oy} + 2(D_{ox} - D_{oy})]$$

$$V_g = \pi r^2 g$$

$$V_1 = \pi r^2 [\pi D_{oy} + 2(D_{ox} - D_{oy})] - \pi r^2 g = 0.282\ [13.94 + 2.72] - 0.282 \times 0.7$$

$$V_1 = 4.5\ mm^3$$

We have found surprisingly that when using the principle of this invention with a link whose cross-sectional wire diameter is as in FIG. 19, i.e. 0.8 mm, and reducing the shorter internal diameter ($D_{iy}$) to 0.26 mm, i.e. where X is just over 3, there is obtained about a 25% saving in precious metal and labour costs over the method of U.S. Pat. No. 4,651,517. In the chain according to this invention, the double helix appears to be more elongated than with the prior art chains.

The rope chain of this invention can be made using the same techniques as in the prior art. The links may be oriented with their gaps alternating at 180° or in a different orientation, as long as they are tight fitting one within another.

I claim:

1. In a jewelry rope chain having tightly interfitting links made of wire of a given cross-section, each link having a small gap formed therein slightly larger than a cross-section of said wire, so as to enable one of said links to pass through the gap of a second link, said links being intertwined to fit tightly one against the other and form in outward appearance a double helix, the improvement comprising each link being of a noncircular elongated shape and including a major axis defining longer outer and inner diameters and a minor axis defining shorter outer and inner diameters, said gap lying in a link section parallel to the major axis, said shorter inner diameter being just over X times greater than the cross-section of the link wire, where X is a number equal to or greater than 2, said interfitting links being positioned in the chain so that said longer outer diameter defines a width of the chain.

2. A rope chain as in claim 1 wherein the links have geometric shapes selected from oval, rectangle or polygonal.

3. A rope chain as in claim 1 wherein the link wire cross-section is solid, hollow or semi-hollow.

4. A rope chain as in claim 1 wherein the links are substantially curved in the direction of the minor axis and are substantially flat in the direction of the major axis.

5. A rope chain as in claim 1 wherein the cross-section of the link wire is selected from the group comprising round, oval and polygonal.

6. A rope chain as in claim 1 wherein the ratio of the shorter internal diameter of the link to the cross-sectional diameter of the wire is somewhat greater than 3.

7. A rope chain as in claim 1 wherein the ratio of the shorter internal diameter of the link to the cross-sectional diameter of the wire is somewhat greater than 4.

8. A rope chain as in claim 1 wherein the ratio of the shorter internal diameter of the link to the cross-sectional diameter of the wire is somewhat greater than 5.

* * * * *

US004996835B1

REEXAMINATION CERTIFICATE (1721st)

United States Patent [19]

Rozenwasser

[11] B1 4,996,835

[45] Certificate Issued Jun. 16, 1992

[54] FINE JEWELRY ROPE CHAIN

[76] Inventor: David Rozenwasser, 26 Har Dafna Street, Savion, Israel

Reexamination Request:
No. 90/002,403, Aug. 16, 1991

Reexamination Certificate for:

| | |
|---|---|
| Patent No.: | **4,996,835** |
| Issued: | **Mar. 5, 1991** |
| Appl. No.: | **460,023** |
| Filed: | **Jan. 2, 1990** |

[30] Foreign Application Priority Data

Dec. 8, 1989 [IL] Israel ..... 92607

[51] Int. Cl.[5] ..... B21L 5/02

[52] U.S. Cl. ..... 59/80; 59/3; 59/83

[58] Field of Search ..... 59/1, 3, 16, 20, 25, 59/35.1, 78, 80, 83

[56] References Cited

U.S. PATENT DOCUMENTS

| | | | |
|---|---|---|---|
| 848,299 | 3/1907 | Feid | 59/35.1 |
| 944,640 | 12/1909 | Ungerer et al. | 59/1 |
| 979,110 | 12/1910 | Ungerer et al. | 59/1 |
| 1,011,973 | 12/1911 | Leibbrand | 59/35.1 |
| 1,053,726 | 2/1913 | Hamm et al. | 59/1 |
| 1,055,751 | 3/1913 | Hurley | 59/80 |
| 1,886,784 | 11/1932 | Boppenhausen | 59/83 |
| 4,493,183 | 1/1985 | Bucefari et al. | 59/16 |
| 4,503,664 | 3/1985 | Allazzetta et al. | 59/16 |
| 4,651,517 | 3/1987 | Benhamou et al. | 59/80 |

FOREIGN PATENT DOCUMENTS

| | | | |
|---|---|---|---|
| 2829854 | 1/1980 | Fed. Rep. of Germany | 59/23 |
| DM14648 | 9/1989 | Hague | 59/80 |
| DM16267 | 3/1990 | Hague | 59/80 |
| 0050750 | 5/1981 | Japan | 59/35.1 |
| 8604491 | 8/1986 | PCT Int'l Appl. | 59/80 |

*Primary Examiner*—David B. Jones

[57] ABSTRACT

A jewelry rope chain having tightly interfitting links made of wire of a given cross-section, each link having a small gap formed therein slightly larger than the cross-section of said wire, so as to enable one of said links to pass through the gap of a second such link, said links being intertwined to fit tightly one against the other and form in outward appearance a double helix, the improvement being that each link comprises a non-circular geometric shape, said shape comprising a major axis defining long outer and inner diameters and a minor axis defining shorter outer and inner diameters, said gap lying in a link section parallel to the major axis and said shorter inner diameter being just over X times greater than the cross-section of the link wire, where X is a number equal to or greater than 3.

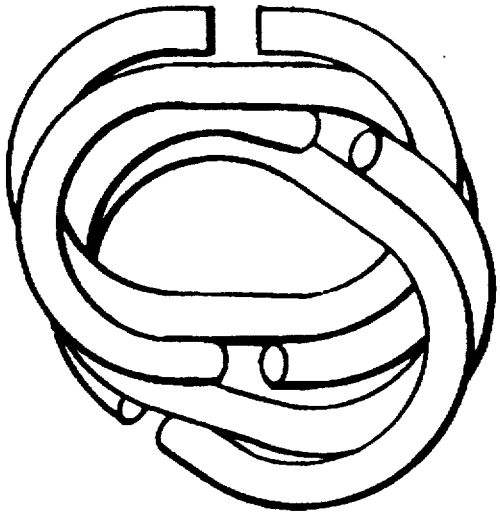

REEXAMINATION CERTIFICATE ISSUED UNDER 35 U.S.C. 307

AS A RESULT OF REEXAMINATION, IT HAS BEEN DETERMINED THAT:

The patentability of claims 1, 2, 3, 4, 5, 6, 7 and 8 is confirmed.

* * * * *